US006382109B1

(12) United States Patent
Novikoff

(10) Patent No.: US 6,382,109 B1
(45) Date of Patent: May 7, 2002

(54) SELF-LEVELING MODULAR TABLE AND METHOD OF FORMING A LEVEL MODULAR TABLE

(75) Inventor: Leon Novikoff, Fort Worth, TX (US)

(73) Assignee: Novikoff, Inc., Fort Worth, TX (US)

( * ) Notice: Subject to any disclaimer, the term of this patent is extended or adjusted under 35 U.S.C. 154(b) by 0 days.

(21) Appl. No.: 09/598,772

(22) Filed: Jun. 14, 2000

(51) Int. Cl.[7] ..... A47B 1/00
(52) U.S. Cl. ..... 108/65
(58) Field of Search ..... 108/64, 65, 70, 108/83, 66, 67, 69

(56) References Cited

U.S. PATENT DOCUMENTS

| | | | | | |
|---|---|---|---|---|---|
| 2,840,431 | A | * | 6/1958 | Budai | 108/64 X |
| 3,342,147 | A | | 9/1967 | Shettles | 108/64 |
| 4,150,830 | A | * | 4/1979 | Pokorny et al. | 108/64 |
| 4,409,906 | A | * | 10/1983 | Alneng | 108/64 X |
| 4,915,034 | A | * | 4/1990 | Grabe et al. | 108/64 X |
| 4,922,835 | A | | 5/1990 | Van Vilet et al. | 108/114 |
| 5,144,888 | A | * | 9/1992 | Heine et al. | 108/64 |
| 5,339,747 | A | * | 8/1994 | Epps | 108/64 |
| 5,595,126 | A | | 1/1997 | Yeh | 108/64 |
| 5,673,631 | A | | 10/1997 | Guns et al. | 108/64 |
| 6,032,590 | A | * | 3/2000 | Chen | 108/64 X |
| 6,085,668 | A | * | 7/2000 | Kanki | 108/64 X |
| 6,158,358 | A | * | 12/2000 | Prendergast | 108/64 |

* cited by examiner

*Primary Examiner*—Jose V. Chen
(74) *Attorney, Agent, or Firm*—Bracewell & Patterson, LLP

(57) ABSTRACT

A self-leveling table assembly comprising at least two table segments having multiple sides and a top surface, wherein each table segment has interface regions on each side, each interface region having a half-groove therein. The at least two table segments abut one another so that the interface regions of each table segment form a full-groove there between. A leveling bar is located within the full-groove to level the at least two table segments relative to one another, thereby forming a level table, the top surfaces of the segments being within the same plane.

14 Claims, 3 Drawing Sheets

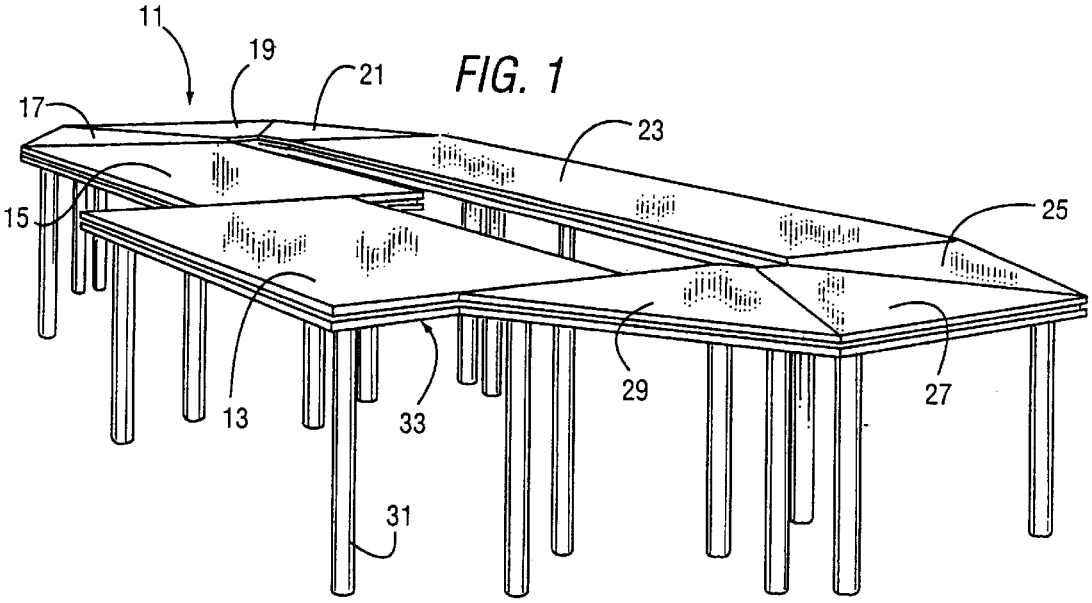
FIG. 1
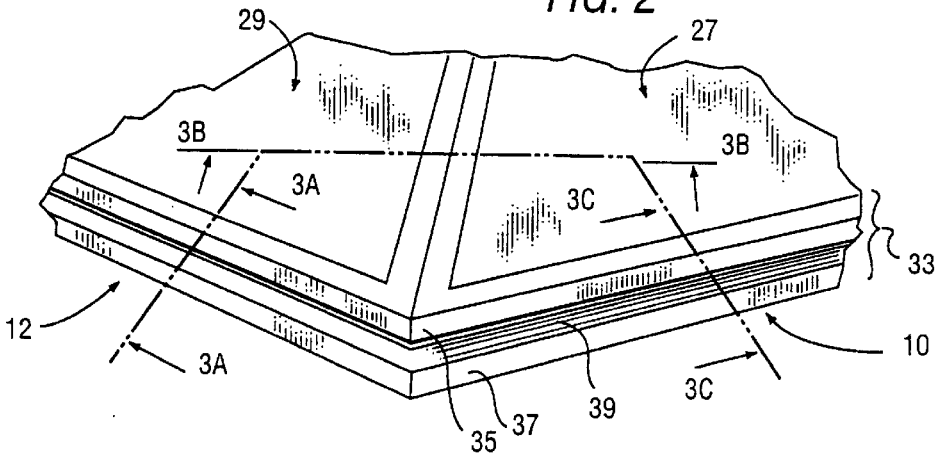
FIG. 2
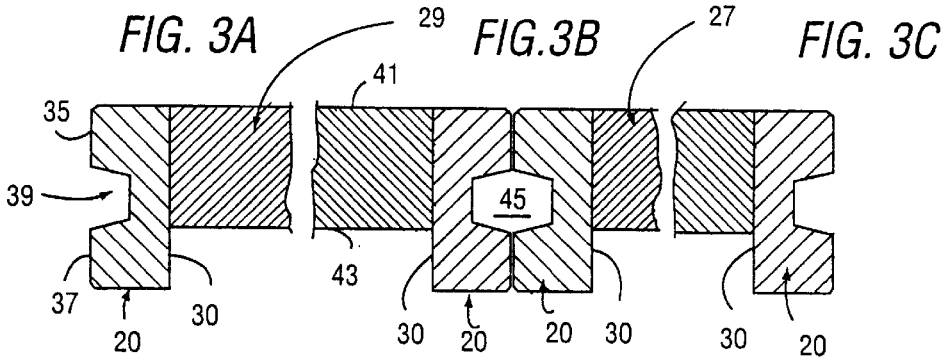

FIG. 4A
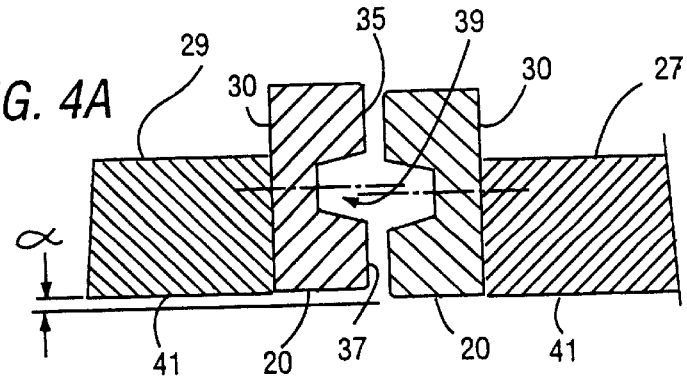
FIG. 5
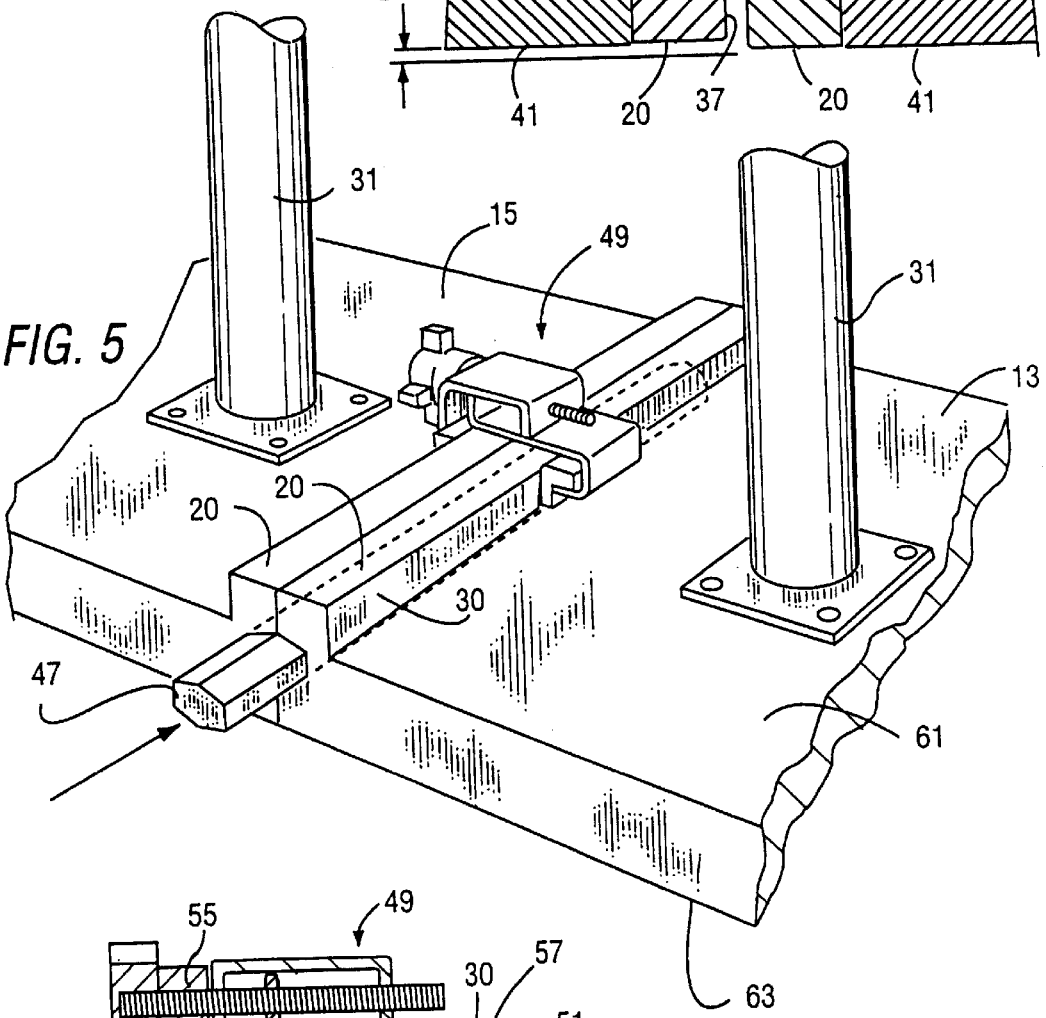
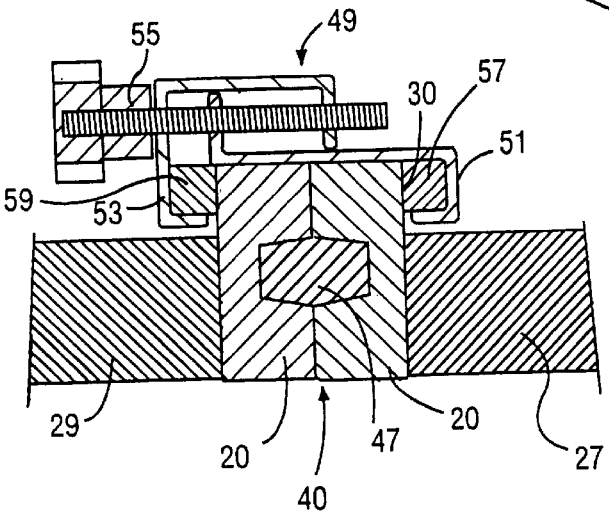
FIG. 4B

SELF-LEVELING MODULAR TABLE AND METHOD OF FORMING A LEVEL MODULAR TABLE

BACKGROUND OF THE INVENTION

1. Field of the Invention

The present invention relates to furniture and methods of assembling furniture. More particularly, the present invention relates to assembled tables that are self-leveling and adjustable to various shapes and sizes.

2. Description of the Prior Art

Modular furniture systems are commonly used, especially in an office environment where interchangeability between various components of furniture is desirable. Further, modular table systems are particularly useful in both office and restaurant environments, where there is often a desire to have smaller tables in one situation, while having the flexibility to join tables to have a larger seating or working area in other situations.

A large variety of ready-to-assemble furniture systems are commercially available at the present time. While such systems do feature ease of assembly, they have often not exhibited the appearance of factory-assembled furniture. For example, certain of the prior art ready-to-assemble systems have exhibited the tendency to loosen up or come apart after extended use. Such systems have included, for example, wood-based office furniture such as desks, credenzas, book cases, lateral files, computer stands, and the like. While such systems offered ease of assembly, they were not necessarily directed toward facilitating the reconfiguration of component parts of a modular furniture system. This is especially the case with modular tables, which, in many environments, require a high degree of professional appeal as well as reliability and ease of assembly.

Specifically, there re several types of expandable tables now in use or disclosed. Guns et al. (U.S. Pat. No. 5,673,631) disclose a table joining leaf that is directed towards joining round tables together. While this table arrangement joins independent tables together, it does not ensure that the table top will be smooth and planar. In many office environments, it is highly desirable to have joining table systems that are self-leveling in that the table top thus formed is a smooth, planar surface. This allows the user(s) to perform such tasks as writing and drafting without the need for any secondary cover for the table.

Yeh (U.S. Pat. No. 5,595,126) discloses a table having individually formed units of different geometric shapes. A mortis is formed within the edge of each unit, and tenons are used to help join the abutting mortis edges. The tenons do not run the length of the mortis joint, however, and there is thus no way of making the table tops leveling. Van Vliet et al. (U.S. Pat. No. 4,922,835) also disclose a table having multiple units. Again, there is no way of leveling the table top surface in Van Vliet et al., as this invention is directed towards a table top having interchangeable leg members. While the Yeh and Van Vliet et al. tables are adequate for general use, they do not ensure a continuous, smooth top surface as often is required in an office or workstation.

There is a desire in workstation tables to have a continuous, level table tip. Drawing, drafting, writing, and other tasks are often performed on these tables that requires a highly planar table top. Further, in meeting situations, it is desirable to have a table that is professional in appearance such as to have a finished, continuous appearance. There is thus a need for a table that is modular in nature, and self-leveling.

SUMMARY OF THE INVENTION

It is therefore one object of the present invention to provide a table that can be formed into various shapes and sizes, while also being self-leveling.

It is another object of the present invention to provide a modular table assembly that is simple to use and economical.

It is yet another object of the present invention to provide a modular table assembly that is professional and aesthetically pleasing in appearance once formed.

These and other objects are achieved by providing a self-leveling table assembly comprising at least two table segments having multiple sides and a top surface. Each table segment has interface regions on each side, and each interface region further has a multi-sided half-groove located therein. The at least two table segments abut one another in the table assembly so that the interface regions of each table segment form a complex, symmetrical groove. A hexagonal full-groove is formed there between in the preferred embodiment. To level the table, a hexagonal leveling bar is placed within the full-groove to level the at least two table segments relative to one another, thereby forming a level table, the top surfaces of the segments being within the same plane.

Each table segment has an edging with an extent extending from the table segment bottom surface. This allows the placement of at least one leveling clamp to secure the two abutting interface regions against one another. The leveling bar extends the length of the full-groove formed between the table segments, thereby leveling the table top and providing a continuous, planar surface with minimal discontinuity in the top surface formed.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a perspective view of a table assembly of the invention;

FIG. 2 is a close-up perspective view of the table assembly of the invention in FIG. 1;

FIG. 3A is a cross-sectional view taken from FIG. 2;

FIG. 3B is a cross-sectional view taken from FIG. 2;

FIG. 3C is a cross-sectional view taken from FIG. 2;

FIG. 4A is a cross-sectional view of a joint between two table segments;

FIG. 4B is a cross-sectional view of a joint between two table segments after installing a clamp;

FIG. 5 is a perspective view of the bottom of an assembled table;

DESCRIPTION OF THE INVENTION

Figure 6A:
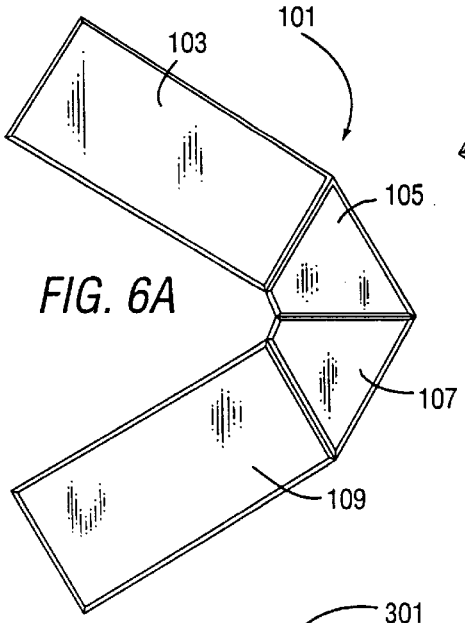
FIG. 6A is a top view of one embodiment of the table assembly of the invention.

The present invention is a self-leveling table assembly and a method of assembling a series of smaller table segments into a larger unitary table having a continuous, planar top surface and various overall shapes. The table can be made from most any materials such as whole wood, wood composites, wood/polymer composites, polymer-plastics, metals, and other suitable furniture material. The table is self-leveling in that the individual table segments are brought together and joined such that there is continuity between each table top, and the plane of each flat table top lies in the plane of the other table tops.

The self-leveling table is made up of at least two table segments having multiple sides, typically three or four, and a flat, planar top surface. Each table segment may also have any number of legs to be used as support structures in conjunction with the other legs of joining table segments. Also, some or all of the table segments may have no legs, the table top thus formed having other supporting structures to hold the table top above the level of the floor.

Each table segment has interface regions on each of its sides, each interface region having a half-groove therein. In the preferred embodiment, the half-groove is three-sided, such as a halved hexagon. It is to be understood that other complex geometric shapes can be incorporated into the interface region, the purpose of the interface to allow the smooth abutment of adjoining table segments. Also, the interface has an aesthetic purpose when not joined to a table segment, serving as an outer edge to the final self-leveling table thus formed. The complex interface is finished in such a manner as to have an attractive appearance.

In forming the table, the at least two table segments abut one another so that the interface regions of each table segment form a hexagonal full-groove there between from the half-hexagons or other mirror-image groove shape. Thus, a continuous groove is formed that will allow the placement of a mating leveling bar therein. Preferably, a hexagonal leveling bar is located within the full-groove to level the at least two table segments relative to one another, thereby forming a level table. In the level table thus formed, the top surfaces of the segments are within the same plane.

In order to facilitate the joining of each table segment, each segment has an edging with an extent extending from the table segment bottom surface. The extent allows at least one leveling clamp to secure two abutting interface regions against one another. The leveling bar is typically placed within the full-groove prior to tightening the clamp, the full-groove surfaces thus being forced against the leveling bar as the clamp forces the interface regions together.

The invention is described in more detail with reference to the Figures, beginning with FIG. 1 which shows one embodiment of the table assembly of the invention. The table assembly 11 comprises table segments 13, 15, 17, 19, 21, 23, 25, 27, and 29. Each table segment has at least one leg 31 in the present embodiment, but may have more, or none. The plurality of table segments form an oblong octagon in self-leveling table 11. Each table segment has at least one side, typically three to four sides, each side comprising an interface region 33 having a complex geometry. This interface regions serves the functional purpose of joining the table segments together as well as an aesthetic purpose when not joined to another interface region from another table segment.

The assembly formed from the individual table segments is further described with reference to FIG. 2, wherein table segments 27 and 29 are shown, each having sides 10 and 12, respectively. Sides 10 and 12 are not joined to a table segment, thus exposed and in view. Each side comprises the interface region 33, the interface region in the present embodiment having an upper face 35, a lower face 37, and a half-groove 39. In the present embodiment, half-groove 39 is three-sided, as forming a half of a hexagon. The interface region 33 has a dual purpose in that it serves as an outer edge of the formed table once all table segments are in place, while also serving as a means of leveling the thus formed table when used as on interface between smaller table segments.

The structure of the interface region 33 is shown in greater detail in cross-section in FIGS. 3A, 3B, and 3C, wherein the exposed interface regions 33 are shown in FIGS. 3A and 3C, while two interface regions forming an assembly is shown in FIG. 3B. The interface regions are located on edging 20, each table segment having edging on each side. Each edging 20 has an extent 30 that extends down from the bottom surface 43 of the table segments, the bottom surface 43 opposite a top surface 41. The two joined interface regions, each having a half-groove 39, forms a full-groove when placed in an abutting position, each of the corresponding upper and lower faces making firm contact with one another from the table segments 27 and 29.

In the present embodiment, the full-groove 45 is in the shape of a hexagon. Thus, a groove running the length of a side is formed having inner surfaces forming a hexagon. The inner surfaces could also form other complex geometries suitable for forming the assembly of table segments. The purpose of the full-groove 45 is to accommodate a leveling bar having mating outer surfaces, as described with reference to FIGS. 4A and 4B. The leveling bar functions to level the table segments to form a planar, unitary table surface from adjoining top surfaces. For example, in FIG. 4A is shown two adjoining table segments 27 and 29 having a deflection angle $\alpha$ between the planes created by the top surfaces 41. This angle, which is preferably zero in a table assembly of the invention, can be made such by inserting the leveling bar 47 within the full-groove formed from the abutting half-grooves 39.

Once the two table segments are joined such that the respective interfaces 33 abut, the leveling bar 47 can be inserted within the full-groove. With the leveling bar 47 inserted, a leveling clamp 49 can be placed on the bottom surface of the table segment over the two abutting edgings 20, each edging having an extent 30 to allow the clamp to secure the segments 27 and 29 together. The clamp typically has a first bracket 51 and second bracket 53 with a threaded adjuster bolt 55 running there through, or some like clamping arrangement. Blocks 57 and 59 are located within the brackets 51 and to effectuate a firm hold on the extents 30 when the clamp is tightened round the edgings. The thus joined table segments form a continuous table top 40 as shown in FIG. 4B having minimal discontinuity, the angle $\alpha$ being reduced to zero.

Two joined table segments 13 and 15 are shown from the bottom surface 61 in FIG. 5, wherein the clamp 49 is secured to the abutting edging 20 against the extents 30 of each edging. The leveling bar 47 is shown being inserted into the full-groove in the direction of the arrow. The insertion of the leveling bar 47 creates a planar, smooth top surface 63 and thus a continuous table assembly between the joined table segments.

Figure 6B:
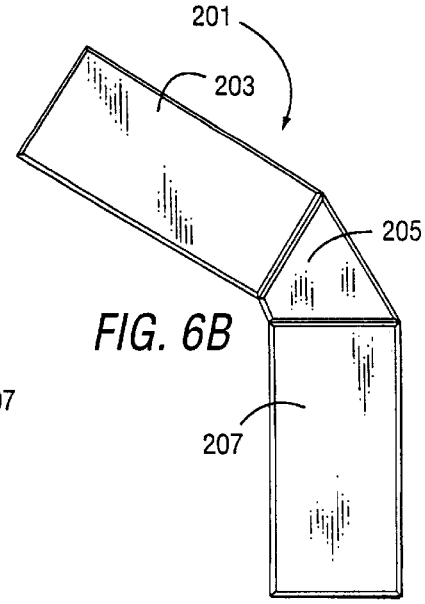
FIG. 6B is a top view of one embodiment of the table assembly of the invention.
Figure 6C:
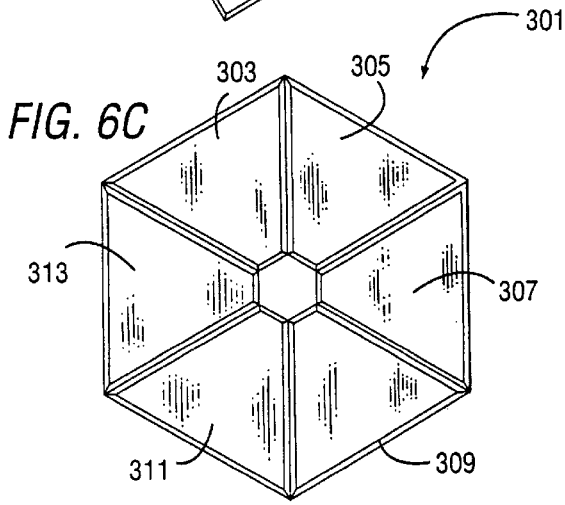
FIG. 6C is a top view of one embodiment of the table assembly of the invention.
Figure 6D:
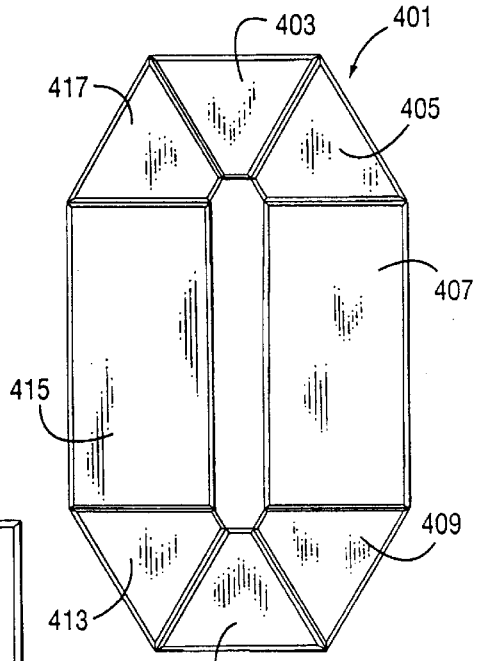
FIG. 6D is a top view of one embodiment of the table assembly of the invention.
Figure 6E:
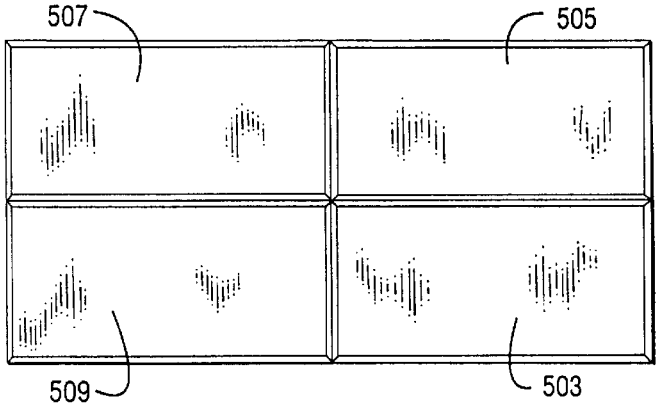
FIG. 6E is a top view of one embodiment of the table assembly of the invention.

The table assembly the invention can be made into any number of configurations, depending upon the size and shape of the table segments used to make the assembly. Several possible embodiments of the table assembly of the invention are described with respect to FIGS. 6A through 6E. Table assembly 101 comprises rectangular table segments 103 and 109, and two trapezoidal segments 105 and 107. The combination of these segments forms a V-shaped assembly. Table assembly 201 is formed from rectangular segments 203 and 207 and a trapezoidal segment 205. Table assembly 301 is formed from 6 trapezoidal segments 303, 305, 307, 309, 311, and 313. The result is that table assembly 301 is a hexagonal shaped table. Table assembly 401 is formed from two rectangular segments 407 and 415, and 6 trapezoidal segments 403, 405, 409, 411, 413 and 417. This arrangement in table 401 forms an elongated octagon, similarly to table 11. Finally, table assembly 501 is formed from four rectangular shaped segments 503, 505, 507 and 509.

There are several advantages to the present table assembly invention. The invention combines the flexibility of modular furniture with the professional appeal of more expensive, whole units of furniture. The table segments are easily assembled into a unitary table, and the table is self-leveling in a simple and reproducible manner with the leveling bar and clamps.

The table assembly of the present invention can be used in a variety of environments including a restaurant environment, or office environment. In either environment, the table assembly is versatile and appealing. Given that the present invention has fewer moving parts as compared to many prior art modular tables, the present table will be more reliable and more easily manufactured.

Thus, it can be appreciated that the above described embodiments and advantages are merely illustrative of just a few of the numerous variations and arrangements of the invention. Thus, while the invention has been shown in only one of its forms, it is not thus limited but is susceptible to various changes and modifications without departing from the spirit thereof.

What claimed is:

1. A professional and aesthetically pleasing self-leveling table assembly comprising:

at least two table segments having multiple sides and a top surface, wherein each table segment has interface regions on each side, each interface region having a multi-sided half-groove therein;

the at least two table segments abutting one another so that the interface regions of each table segment form a polygonal full-groove there between; and wherein a unitary polygonal leveling bar is located within the full-groove to level the at least two table segments relative to one another, thereby forming a level table, the top surfaces of the segments being within the same plane and wherein all leveling forces on the two table segments originate from within the full-groove.

2. The table assembly of claim 1, wherein each table segment has an edging with an extent extending from the table segment bottom surface.

3. The table assembly of claim 1, wherein at least one leveling clamp secures two abutting interface regions against one another.

4. The table assembly of claim 1, wherein the leveling bar extends the length of the full-groove formed between the table segments.

5. The table assembly of claim 1, wherein the leveling bar has an outside geometry that mates with the inside geometry of the full-groove.

6. A professional and aesthetically pleasing self-leveling table assembly comprising:

at least two table segments having multiple sides and a top surface, wherein each table segment has interface regions on each side, each interface region having a three-sided half-groove therein;

the at least two table segments abutting one another so that the interface regions of each table segment form a hexagonal full-groove there between; and wherein a unitary hexagonal leveling bar formed of wood is located within the full-groove to level the at least two table segments relative to one another, thereby forming a level table, the top surfaces of the segments being within the same plane.

7. The table assembly of claim 6, wherein each table segment has an edging with an extent extending from the table segment bottom surface.

8. The table assembly of claim 6, wherein at least one leveling clamp secures two abutting interface regions against one another.

9. The table assembly of claim 6, wherein the leveling bar extends the length of the full-groove formed between the table segments.

10. A method of forming a professional and aesthetically pleasing self-leveling table assembly, the method comprising:

providing at least two table segments having multiple sides and a top surface, wherein each table segment has interface regions on each side, each interface region having a multi-sided half-groove therein;

abutting the at least two table segments against one another so that the interface regions of each table segment forms a polygonal full-groove there between; and inserting a unitary polygonal leveling bar within the full-groove to level the at least two table segments relative to one another, thereby forming a level table, the top surfaces of the segments being within the same plane with the leveling bar presenting a clean and smooth profile below the table.

11. The table assembly of claim 10, wherein each table segment has an edging with an extent extending from the table segment bottom surface.

12. The table assembly of claim 10, wherein at least one leveling clamp secures two abutting interface regions against one another.

13. The table assembly of claim 10, wherein the leveling bar extends the length of the full-groove formed between the table segments.

14. The table assembly of claim 10, wherein the leveling bar has an outside geometry that mates with the inside geometry of the full-groove.

* * * * *